United States Patent [19]

Schmid

[11] Patent Number: 4,509,752

[45] Date of Patent: Apr. 9, 1985

[54] RETURNED BOWLING BALL LIFTING APPARATUS

[75] Inventor: August Schmid, Schwerzenbach, Switzerland

[73] Assignee: Patentverwertungs-u, Finanzierungsgesellschaft Seranta AG, Glaurus, Switzerland

[21] Appl. No.: 530,115

[22] Filed: Sep. 8, 1983

[30] Foreign Application Priority Data

Sep. 14, 1982 [CH] Switzerland ..... 5441/82

[51] Int. Cl.[3] ..... A63D 5/02

[52] U.S. Cl. ..... 273/49

[58] Field of Search ..... 273/43 R, 43 A, 49

[56] References Cited

U.S. PATENT DOCUMENTS

| | | | |
|---|---|---|---|
| 2,717,155 | 9/1955 | Huck | 273/49 |
| 2,803,463 | 8/1957 | Congelli | 273/49 |
| 3,572,708 | 3/1971 | Schmid | 273/49 |

*Primary Examiner*—Anton O. Oechsle

*Attorney, Agent, or Firm*—Frishauf, Holtz, Goodman & Woodward

[57] ABSTRACT

In bowling establishments, the bowling balls being returned on a ball return race must be lifted to a higher level in the vicinity of the player's position. This is effected by means of a belt drive, which is seated on a pivotable ball lift mechanism (6). If a ball (3) is not engaged by the belt (9), a feeler causes the arm (12) of the pivotable mechanism (6) to be lowered, as a result of which the ball is engaged by the belt (9) and is transported obliquely upward along the return race (2). As a result of this upward movement of the ball (3), the pivotable ball lift mechanism (6) is pivoted in the direction of the arrow A and the latch arm (22) again locks into place behind the latch (32), so that the pivotable ball lift mechanism (6) subsequently assumes its normal position. The operational reliability of the apparatus is thereby increased, because even balls (3) rolling quite closely to one another are lifted with assurance to the proper level.

15 Claims, 10 Drawing Figures

RETURNED BOWLING BALL LIFTING APPARATUS

The apparatus relates to the handling of bowling balls, and more particularly to an apparatus adapted for installation close to the player's position to supply bowling balls being returned from the pin position of a bowling alley or the like to the players.

BACKGROUND

In bowling establishments, two adjacent lanes are usually associated with one bowling ball return race that is common to both. "Bowling alleys" and "bowling establishments" are understood to include those for both ninepins and ten-pin bowling.

After a bowling ball has been rolled at the pins, it is lifted out of the ball pit by an elevator and then placed on the bowling ball return race or track. Before arriving at the player's position, the arriving bowling balls are braked and lifted up to a level where the player can conveniently reach them.

Apparatus has previously been provided—see the referenced U.S. Pat. No. 2,765,172—to lift a bowling ball by clamping the bowling ball between a guide race and a pivotable lift mechanism which includes a transport belt, driven by a motor, frictionally engaging the bowling ball to race it along the guide path to a desired position. The structure of the referenced U.S. Pat. No. 2,765,172 was designed for placement at the pin position of a bowling alley. The arrival and lifting of bowling balls is readily controlled at that position. Only a single bowling ball will be received at the pin position at any one time.

Placement of such an apparatus as the player's position causes difficulties. The bowling ball must reach the lifting position with a minimum speed in order to be engaged by the transport belt. A further precondition for satisfactory ball transporting is that the transport belt not already be occupied by a previous ball.

If two bowling balls happen to arrive on the ball return race one close behind the other, it may be that in conventional apparatus of this kind only the first ball will be lifted, while the following ball stops where it is. When a disruption of this kind occurs, the race has to be cleared by hand, which involves the tedious removal of the covering boards.

THE INVENTION

It is an object to provide a bowling ball lifting mechanism which is suitable for installation at the player's position, in which bowling balls can be reliably lifted and fed to a pick-up position, convenient for players, regardless of the sequence of arrival of bowling balls or their position just prior to being picked up by the bowling ball lifting apparatus.

Briefly, a feeler is provided, extending into the path of the bowling ball on the bowling ball race, or track, the feeler sensing the direction of movement of a bowling ball, for instance forward, and in proper direction, or on bounce-back, or roll-back, or, alternatively, a stop position of a bowling ball which is just coasting towards the pick-up position. The feeler, upon sensing that the bowling ball is not moving properly in the delivery path, or a stop, triggers a release mechanism for the lifting belt holding apparatus to lower the lifting belt holding apparatus against the bowling ball, so that the bowling ball will be properly fed thereby to the lifting position. Under normal operation, the lifting mechanism itself is clear of the bowling ball to permit the bowling ball to run thereunder and move in its path as determined by the bowling ball race or track. Lowering the lifting mechanism permits gripping of a bowling ball which has stopped in the path or track, or which has rolled backwards, and still feeding of the ball by a moving belt to the player's pick-up. A reset arrangement is provided to reset the lifting mechanism to the normal position after the bowling ball has been delivered, so that subsequent balls, sent down the track or race from the pin position, can be properly raised or, if not properly received, the feeler can then control the mechanism to lower position for feed of the bowling ball, as above described.

The system has the advantage of improved reliability in operation, and making lifting of the bowling ball independent of the receipt speed of the bowling ball; additionally, it permits lifting of the bowling balls regardless of tolerances in diameter thereof and insures uninterrupted, orderly transport of the bowling balls. If a plurality of bowling balls, for example upon closing of the bowling alley, are fed one after the other into the return path, race or track, the bowling balls are still supplied to the delivery position and, upon energization of the raising mechanism, the bowling balls will be fed to the delivery position, one after the other.

DRAWINGS

DETAILED DESCRIPTION

Figure 1:
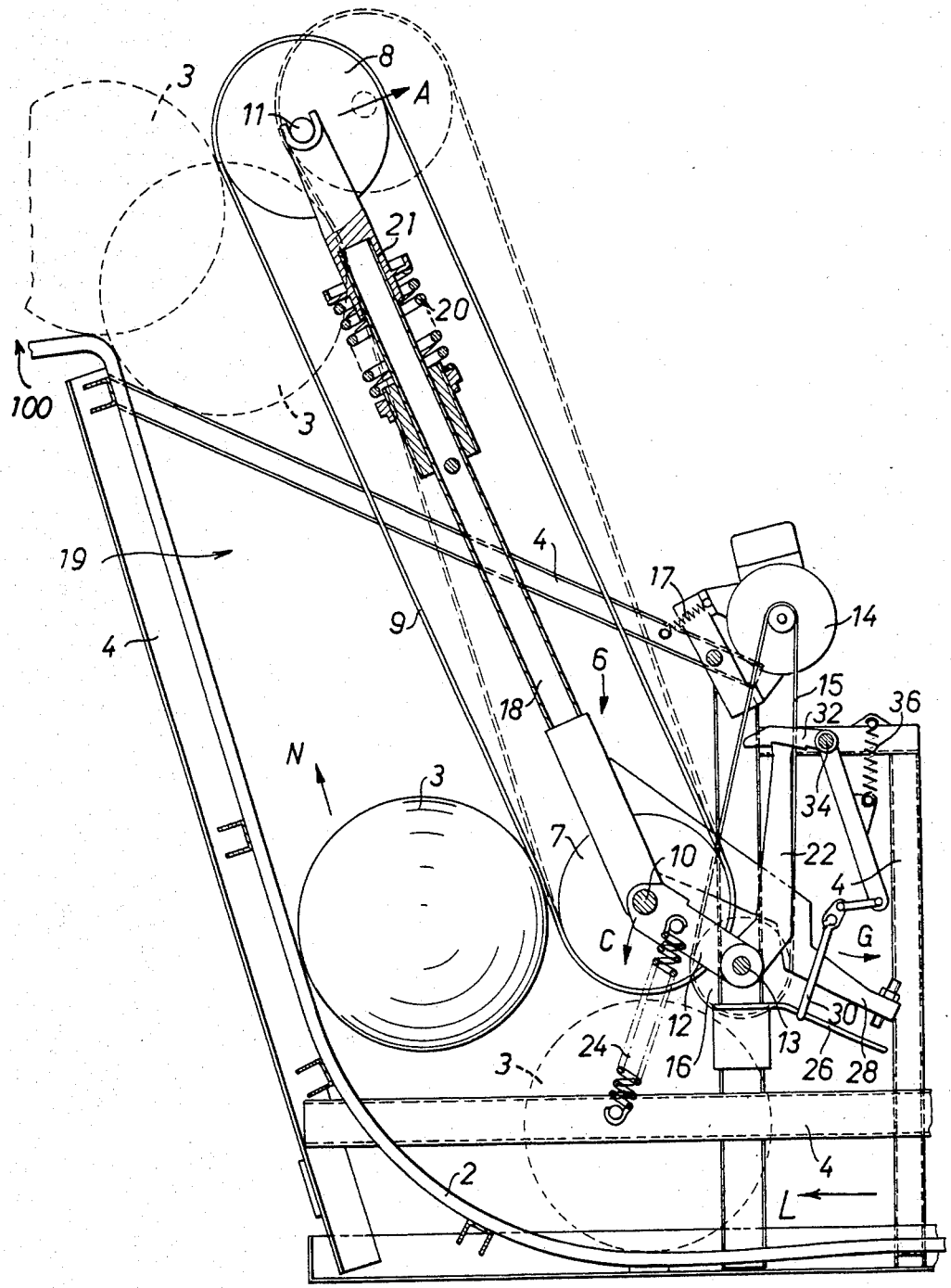
FIG. 1 is an overall view of the apparatus according to the invention.

The apparatus serves to return bowling balls in a bowling establishment to the player's position 100 for pickup by the players, the bowling balls 3 rolling back to the players on a return race or track 2. The balls 3 are raised out of the ball pit by an elevator and then lowered from a certain height onto the race 2 for return; there, they roll back at a certain speed toward the player's position 100. In the vicinity of this position 100, the bowling balls 3 are raised to a comfortable height for being grasped and are then released gently at that level to a ball collection area.

The race 2 is connected, in the area where it inclines upward, with a frame 4, and the race includes a piece directed obliquely upward. For moving the bowling balls 3 upward, a motor-driven belt drive is seated on a pivotable ball lift mechanism 6, a flat belt 9 being disposed about a lower drive roller 7 and an upper roller 8. The belt 9 is tightened by a spring 20, which rests against a tubular part engaging the pivotable arm 18 of the ball lift mechanism 6 in telescoping fashion. A pivotable arm 18 is pivotable about a link shaft 10 of the ball lift mechanism 6, and in the position of rest—that is, when no ball is being transported—the arm 18 assumes a position shown in solid lines in FIG. 1. By means of stops and springs, not shown, the ball lift mechanism 6 is supported in this position. If on the other hand a ball 3 is being transported in the direction of the arrow N, the ball lift mechanism 6 executes a pivoting movement in the direction of the arrow A, so that it assumes the position indicated by broken lines in the drawing. The drive of the belt 9 or in other words of the drive roller 7 is effected by means of an electric motor supported in pivotable fashion, which drives a belt disc 16 via a belt 15. The belt disc 16 is rotationally connected with the drive roller 7 via a further endless belt. With the aid of a spring 17, the electric motor 14 is kept in a position such that the belt 15 remains taut.

Normally the bowling ball 3, because of its momentum, rolls into the upwardly inclined area of the race 2, is there engaged by the belt 9 and is then moved upward along this belt 9, so that the ball 3 can finally roll off again at the top. If two balls are traveling close together, it is possible for the rearward ball not to be engaged by the belt 9 because the balls interrupt one another's movement; the speed of the rearward ball is then no longer sufficient to move it into the curved part of the race 2. In order to insure that even balls in this condition are transported upward properly, the ball lift mechanism 6 is embodied such that it is adjustable in height; that is, it is pivotable—or in other words lowerable—about an arm 12 or a pair of arms in the direction of the arrow C. This pivoting movement is effected about a shaft 13 which is supported in the frame 4.

Figure 2:
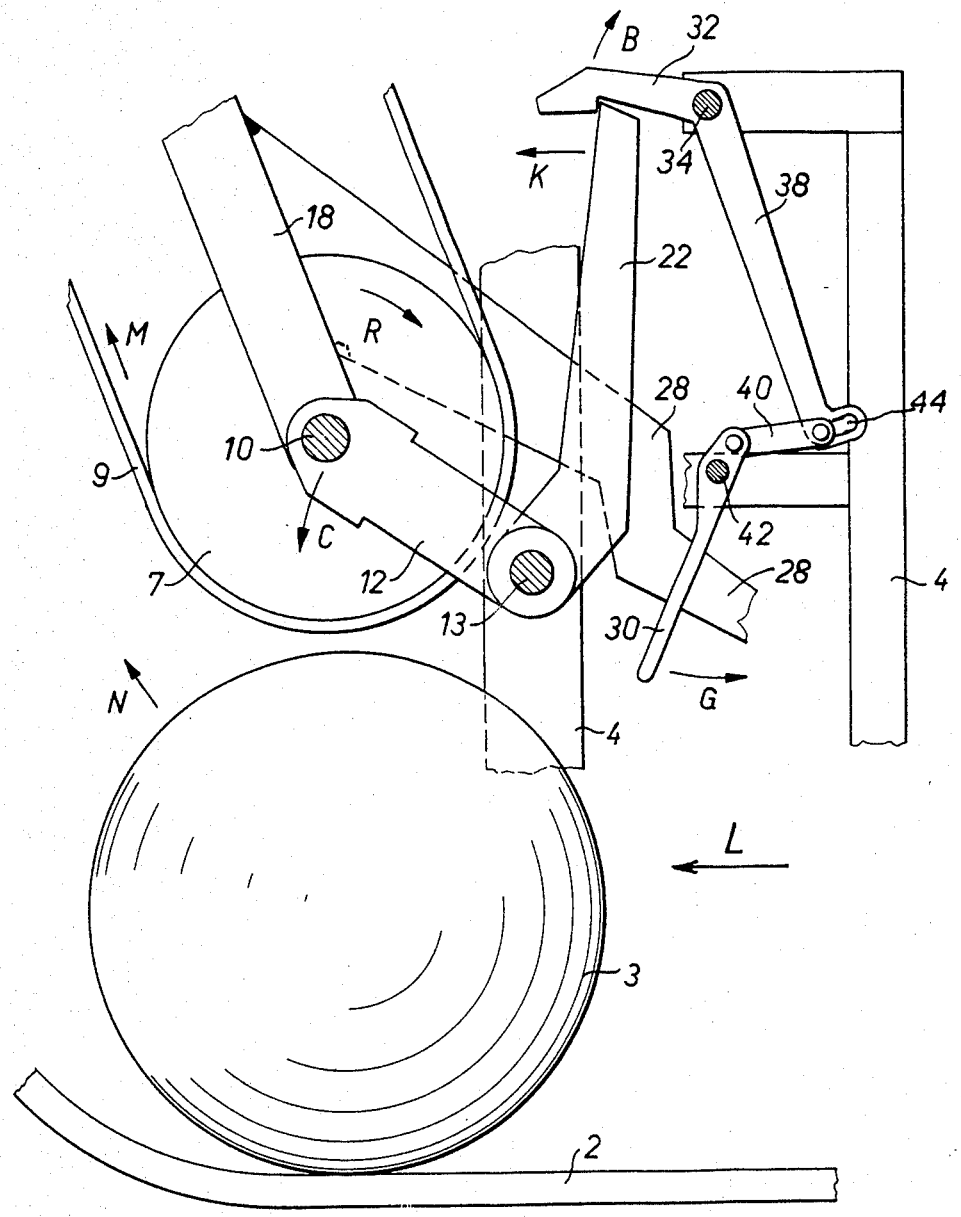
FIG. 2 is a partial view of the apparatus, with the pivotable ball lift mechanism located in the normal raised position.
Figure 3:
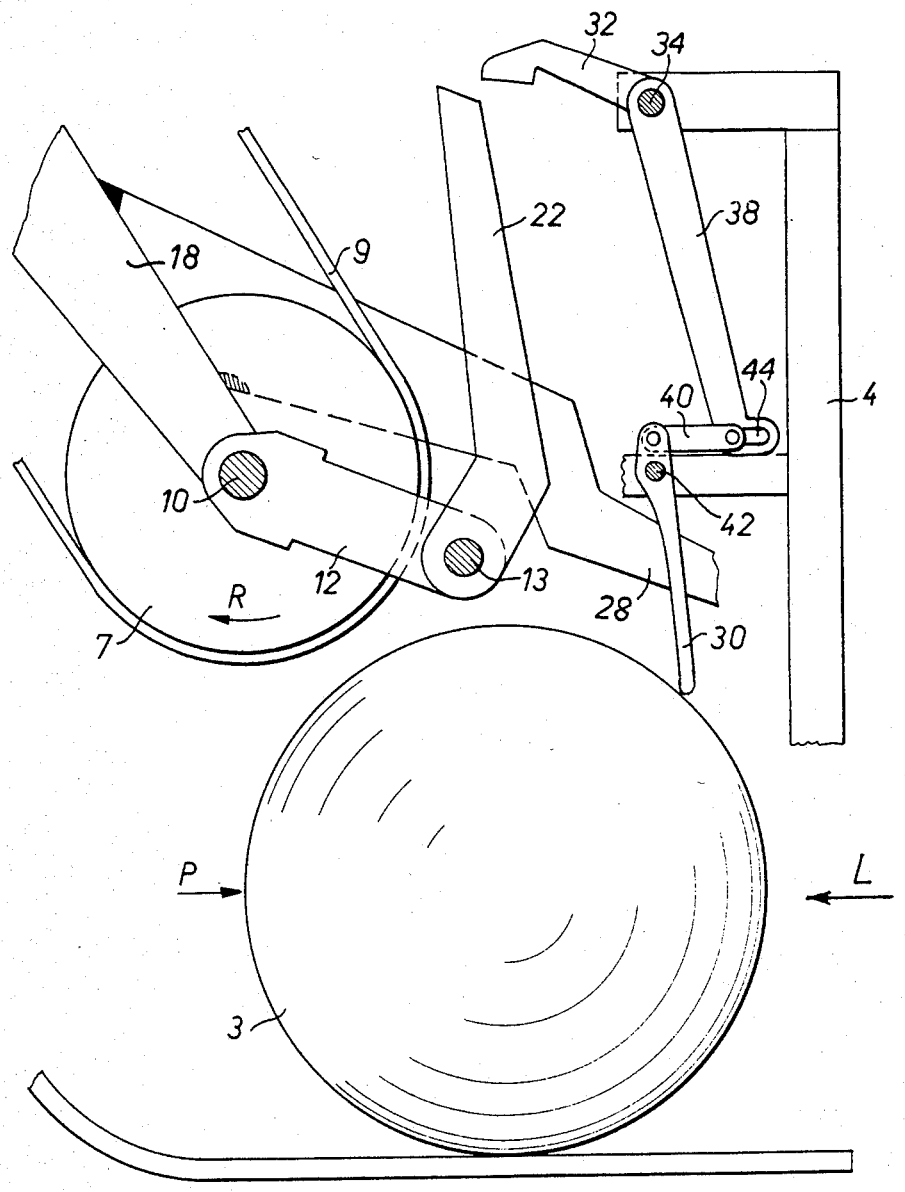
FIG. 3 is a view analogous to FIG. 2, but with the ball lift mechanism in the lowered position.

Since the lowering of the pivotable ball lift mechanism 6 into the position shown in FIG. 3 is supposed to be effected only if a ball 3 happens in an exceptional instance not to be being transported, a trigger mechanism is provided for lowering the ball lift mechanism 6; the trigger mechanism responds whenever a ball executes a backward movement in the direction indicated by the arrow P and thereby moves within the range of movement of a feeler lever 30. This feeler lever 30 executes an idle stroke during normal movement of the ball in the direction L because of the oblong slot 44; it effects a lowering of the arm 12 only if the ball 3 is moving counter to the normal direction L. In that case, this feeler lever 30 executes a movement in the direction of the arrow G (FIG. 2). The feeler lever 30 is held such that it is movable about a pivot shaft 42 and it is articulatedly connected with a connecting rod 40. The connecting rod 40, in turn, is articulated to a latch operating lever 38 via an oblong slot 44. A latch 32 is mounted on the upper end of the latch operating lever 38. A trigger arm 22 is pivotable about the shaft 13 and is rigidly connected with the arm 12. If the latch operating lever 38 pivots about the bolt 35 and the latch 32 comes unlatched in the direction indicated by the arrow B, the trigger arm 22 is capable of executing a movement in the direction of the arrow K. With this trigger arm 22, a movement occurs in the direction of the arrow C of the arm 12.

The pivotable ball lift mechanism 6 is thereby lowered by a few millimeters, for instance from 5 to 15 mm.

OPERATION

If a bowling ball 3 has not previously been engaged by the belt drive of the ball lift mechanism 6 and instead rolls backward in the direction of the arrow B, it strikes the feeler lever 30. This lever is moved in the direction of the arrow G, and as a consequence the latch 32 moves in the direction of the arrow B, so that the trigger arm 22 in turn comes unlatched and the arm 12 assumes the lowered position shown in FIG. 3. In this lowered position, the ball 3 is engaged by the belt 9 and accordingly moved upward along the obliquely rising race 2 in the direction of the arrow N.

Figure 4:
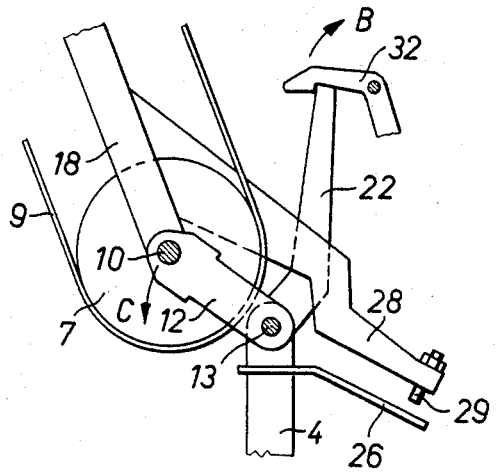
FIG. 4 is a view corresponding to FIG. 2, showing the functioning of the supporting arm.

Since the lowered position of the pivotable ball lift mechanism 6 represents the exceptional case and the balls 3 normally arrive at the vicinity of the ball lift mechanism 6 having sufficient speed, care must be taken that after the ball lift mechanism has been lowered into the position shown in FIG. 3, it will again automatically resume its normal position. This is accomplished by the mechanical means shown in FIGS. 4 and 5. In FIG. 4, the ball lift mechanism 6 is shown in the raised normal position.

In this position, a support arm 28 rigidly connected to the pivotable arm 18 is located a slight distance from a stop 26. This distance can be adjusted by means of a set screw.

Figure 5:
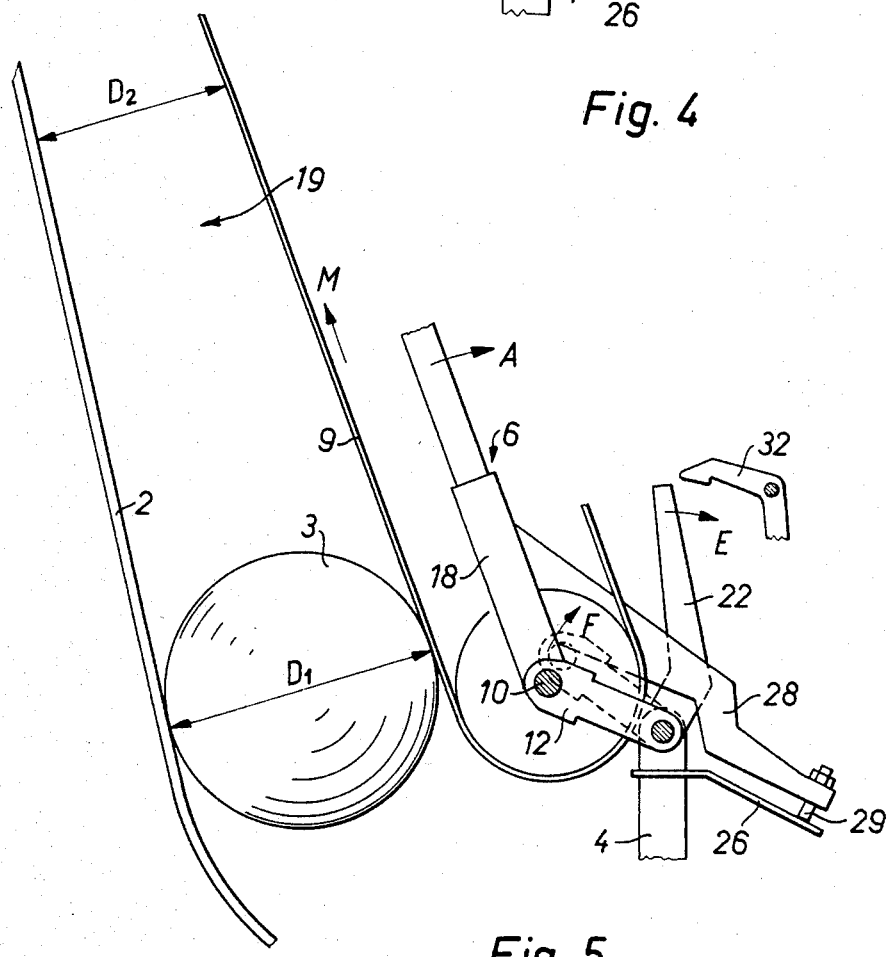
FIG. 5 is a view corresponding to FIG. 4, but with the ball lift mechanism lowered, and showing the means for the automatic raising of the ball lift mechanism during ball transport.

Solid lines in FIG. 5 indicate the lowered position of the ball lift mechanism 6. The set screw 29 comes to rest against the rigid stop 26. The ball lift mechanism 6 is embodied such that the ball transport path narrows toward the top; that is, the diameter $D_1$, corresponding to the ball diameter, is larger than the distance $D_2$ in the vicinity of the upper end of the ball lift mechanism. If a ball 3 is now transported upward by the drive movement of the belt 9, as indicated by the arrow M, this effects a pivoting of the ball lift mechanism 6 in the direction of the arrow A. However, since the support arm 28, via a set screw 29, rests against the rigid stop 26, a fulcrum results at the point of contact between the set screw 29 and the stop 26. As a consequence, the arm 12 is pressed, by the pivoting of the mechanism 6 in the direction of the arrow A, in the direction of the arrow F; the trigger arm 22 is thereby moved in the direction of the arrow E; until it finally latches into place behind the latch 32 once again. The various parts thereupon assume their normal, raised position as shown in FIGS. 1, 2 and 4. The ball lift mechanism 6 is thus automatically restored, from its lowered position, to its normal position, as a consequence of the pivoting movement during the upward movement of the bowling ball 3.

Figure 6:
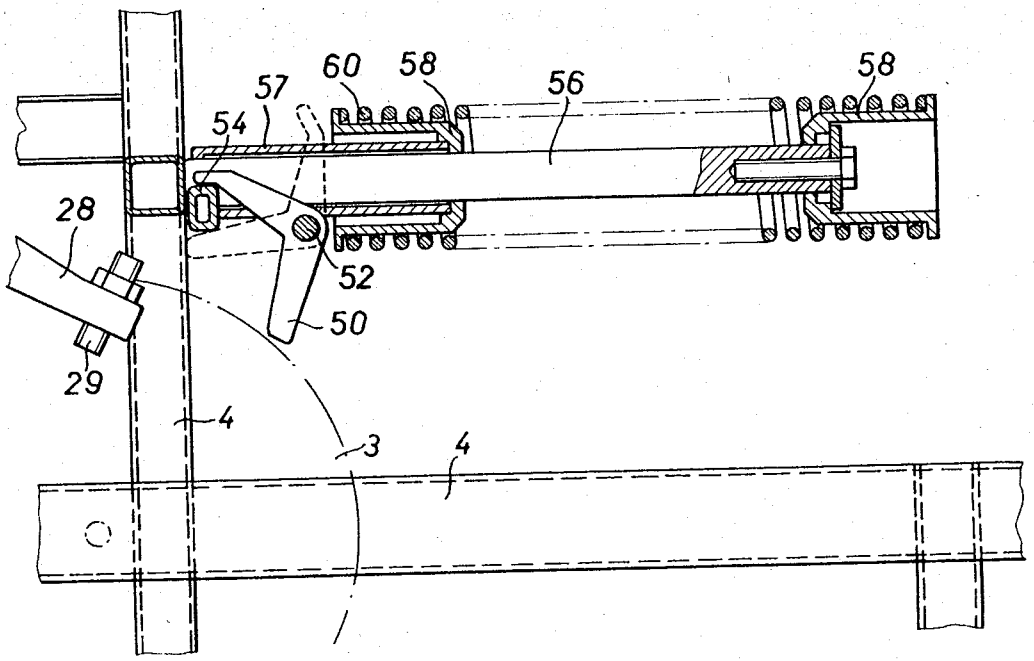
FIG. 6 is a view of the ball-return stop device.

In FIG. 6, a reverse running block means for the bowling ball 3 is shown, which is capable together with the ball of executing a spring movement. If the ball should for any reason not be engaged by the pivotable ball lift mechanism 6, it will roll backward in the direction of the arrow P, where it then strikes the reverse running stopper 50. This bell-crank-like reverse running stopper 50 is supported about a pivot shaft 52 and then presses against an elastic buffer 54. The buffer 54 is seated on a shaft 57, which is connected to a spring guide cap 58, on which there is a helical spring 60. A further spring guide cap 58 is located on the rearward end of a rod 56, supporting the spring 60 in its other end. The reverse running stopper 50 is thus capable, together with the backward-rolling ball 3, of absorbing a certain spring distance, thereby braking the ball 3. If the bowling ball is moving in the opposite direction, that is, in the normal running direction L, the reverse running stopper 50 assumes the position indicated by dashed lines, in which it does not interfere with the travel of the bowling ball 3.

In order to improve the damping of the sound when the balls strike it, the reverse running stopper 50 may be provided, at least on its arm against which the balls come to rest when traveling in the normal running direction, with a yielding, elastic tongue which normally forms a V-shaped gap with that arm.

By means of this apparatus it is assured that the bowling balls 3 cannot remain stopped underneath the pivotable ball lift mechanism 6, but that instead they will in every instance be transported upward because of the possibility provided of lowering the ball lift mechanism 6. On the other hand, the pivotable ball lift mechanism 6 is embodied such that the ball, at its normal speed—which can be up to 6 meters per second—is capable of traveling beneath the drive roller 7 when the ball lift mechanism 6 is in the raised position, being engaged by the belt 9 only when at a higher level. The drive roller 7 is provided with an overrunning clutch known per se, for instance in bicycles, so that if the balls 3 are arriving at a speed greater that that of the belt, the belt 9 will immediately assume the speed of the balls, and a gentle braking to the belt speed takes place only then.

In order to be assured of preventing a ball 3 from coming to a stop before the rising part of the return race 2 and losing its momentum, and in order to actuate the feeler 30, a feeler lever 62 is provided (see FIG. 7) just prior to the rising part of the return race 2; it is pivotable about a pivot shaft 64. Connected with this feeler lever 62 protruding into the movement path of the ball 3 is a mechanical delaying device, which causes the lowering of the ball lift mechanism 6 after a short delay period—for instance, after approximately 0.5 seconds—independently of whether the feeler 30 is actuated. A connecting rod 66 bent at an angle at its top is articulated on the feeler lever 62 via a pin 68. At the upper end of this connecting rod 66, there is a pivot shaft 70, about which this connecting rod 66 is pivoted whever the feeler lever 62 is stressed by the weight of one ball 3. A strap 72 is rigidly connected with the upper end of the connecting rod 66, and a spring 74 is secured to the strap 72 and suspended at the other end on a pivot lever 76. This pivot lever 76 is pivotable about a pivot shaft 42, which at the same time supports the feeler 30, the function of which has been explained in connection with FIGS. 2 and 3. At the upper end of this pivot lever 76, there is a clutch disc 78, which is held such as to be rotatable on a shaft 80 mounted on this pivot lever 76. Rigidly connected to this clutch disc 78 is a pinion 82, which meshes with a gear 83, which in turn is rotatable about a shaft 77 mounted on the pivot lever 76. A friction wheel 84 of larger diameter than the clutch disc 78 rests against the belt 15, which serves to provide the belt drive and is driven by the motor 14 in the direction of the arrow W. As a result, the friction wheel 84 continuously rotates about its shaft 86 in the direction of the arrow T. A friction roller 88 rigidly connected to the friction wheel 84 is seated on this shaft 86. In the normal status, there is a gap 90 between the friction roller 88 and the clutch disc 78. A pull rod 92 is connected to the gear 83 meshing with the pinion 82 and in turn engages a tongue 96 which is rigidly connected with the latch operating lever 38. The suspension point 94 of this pull rod 92 is selected on the gear 83 such that the pull rod 92 is located approximately in the dead center position whenever the elements assume the normal position shown in FIG. 7. The geometrical extension of the longitudinal axis of the pull rod 92 is thus located approximately in the vicinity of the shaft 77 of the gear 83, so that upon a rotation of the gear 83 in the direction of the arrow Z, this pull rod 92 is displaced only slightly at first in the longitudinal direction, because of its near-dead-center position. The pull rod 92 engages a longitudinal slit 98 of the tongue 96, whereupon in the normal position shown in FIG. 7, a slight distance exists between the adjacent end of the slit and the suspension point 97 of the pull rod 92.

Figure 7:
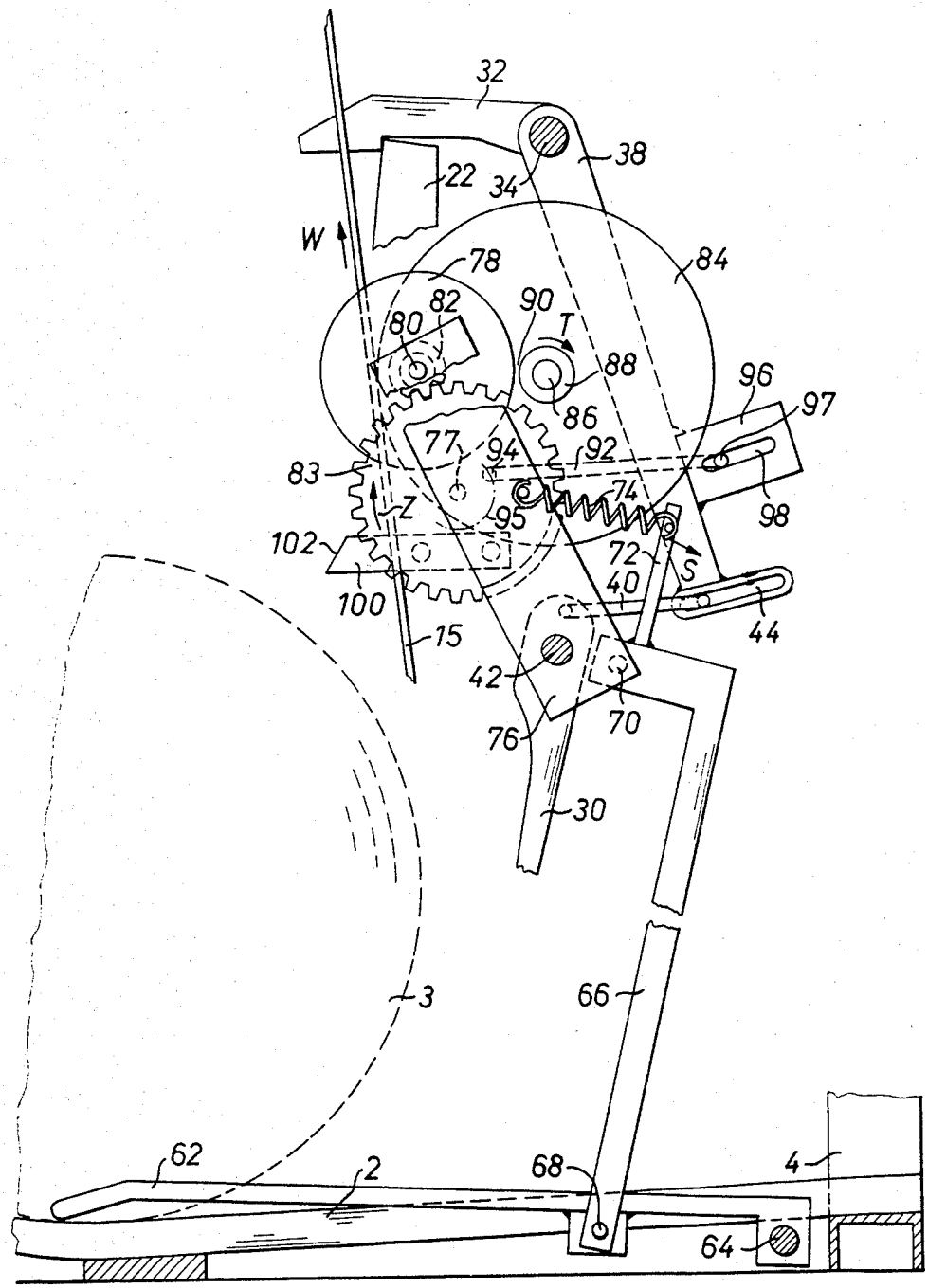
FIG. 7 is a view of a trigger means for lowering the ball lift mechanism, having a mechanical retarding device.
Figure 8:
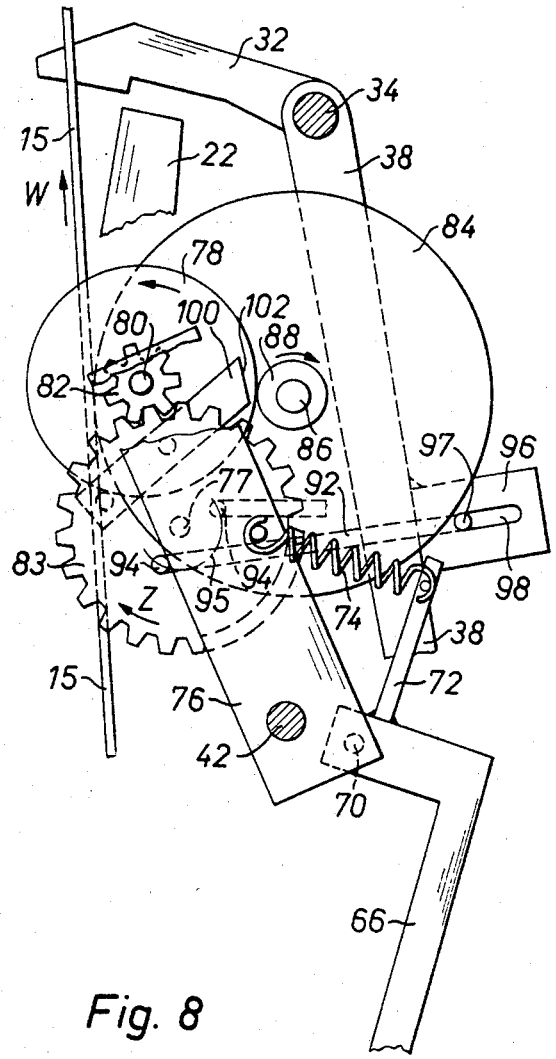
FIG. 8 is a partial view according to FIG. 7, after triggering in order to lower the ball lift mechanism.

Operation, with reference to FIGS. 7 and 8:

In order for the ball lift mechanism 6 to be lowered with assurance even if a ball 3 comes to a stop shortly before the rising portion of the ball race 2 and no longer has enough energy to strike against the feeler 30, the feeler lever 62 executes a mechanical release of the latch 32 after a brief delay period elapses. If the feeler lever 62, under the weight of a bowling ball 3, is pressed downward, the result is that the connecting rod 66 pivots, causing a pivoting movement of the strap 72 in the direction of the arrow S. As a result, tension is exerted via the spring 74 upon the pivot lever 76, causing the coupling disc 78 to be applied against the friction roller 88 and effecting a friction coupling. Since on the other hand the friction wheel 78 is driven by the continuously moving belt 15, the clutch disc 78 moves as well and turns the gear 83 via the pinion 82; the gear 83 then executes a rotational movement in the direction of the arrow Z. As a result, the suspension point 94 of the pull rod 92 moves along the circle of movement 95. At the beginning of this rotation, it causes an idle stroke of the pull rod 92 within the slit 98, and subsequently only a slight movement of the pull rod occurs in the axial direction. Only upon a further rotation of the gear 83 does the pull rod 92 draw the latch operating lever 38 into a position such that the latch 32 comes unlatched in the direction of the arrow B. The result then is a relative position of the various parts such as is shown in FIG. 8. Since the unlatching of the latch 32 by the arm 22 is possible only if a certain resistance is overcome, a corresponding counterforce acts upon the pull rod 92, which counterforce, via the pivot lever 76, causes the force with which the clutch disc 78 is pressed against the friction roller 88 to be increased. As a result of the freeing of the arm 22 by the latch 32, the ball lift mechanism 6 is lowered, as has already been discussed in connection with FIGS. 2 and 3. As a consequence thereof, a ball 3 which has come to a stop is immediately engaged by the belt 9 and the feeler lever 62 is thereby once again released. As a result, in turn, the pivot lever 76 returns to a position such that a gap 90 again forms between the clutch disc 78 and the friction roller 88, and the rotational drive force exerted upon the gear 83 is interrupted. In order to be assured of preventing overrotation of the gear 83, a shunting finger 100 is secured to the gear 83, coming to rest with its oblique surface 102 against the friction roller 88 should the frictional connection for any reason not have been interrupted previously. This is shown in FIG. 8, where after a slight continued rotation of the gear 83 the oblique surface 102 would come to rest against the friction roller 88, then causing an interruption of the frictional engagement between the friction roller 88 and the clutch disc 78. During a normal passage of the bowling ball 3, at normal speed, the feeler lever 62 is actuated only very briefly, this amount of time not sufficing to allow the gear 83 to rotate about an angle such that the pull rod 92 can move the latch operating lever 38 to any substantial extent. If on the other hand the bowling ball 3 rolls backward in the direction of the arrow P and as a result strikes against the feeler 30, this feeler 30 can nevertheless, independently of the movement caused by the pull rod 92, cause the latch operating lever 38 to come unlatched, since both the slit 44 and the slit 90 make it possible for the latch operating lever 38 to execute an idle stroke. Thus these two uncoupling mechanisms can be actuated independently of one another.

Figure 10:
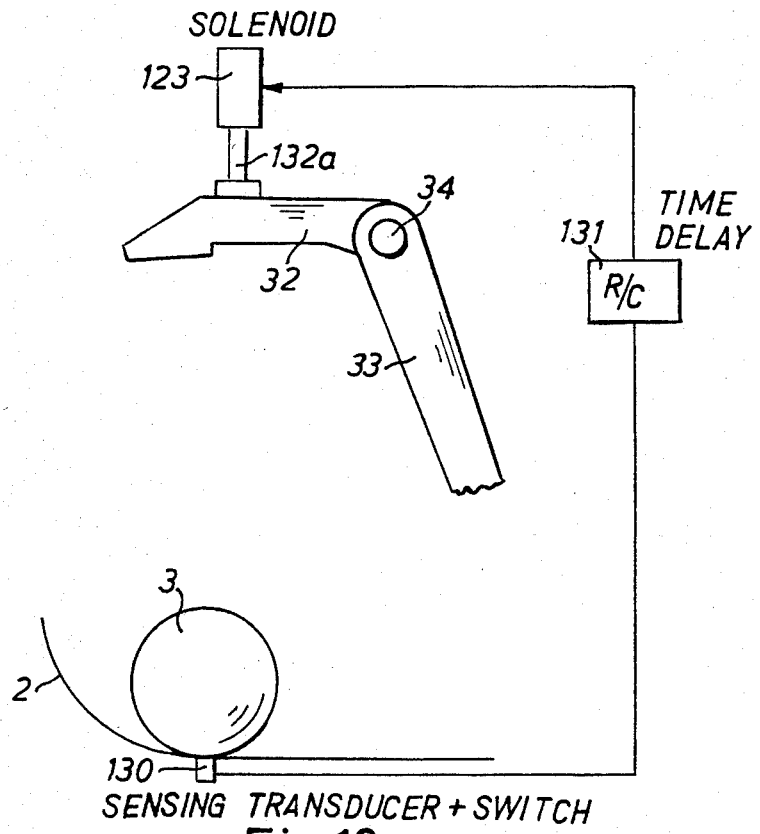
FIG. 10 is a fragmentary circuit diagram illustrating the electromagnetic unlatching operation.

In a further form of embodiment—see FIG. 10—the feeler lever 62 is capable of actuating an electrical transducer and switch 130, which acts via an electrical delay element 131 upon an electromagnet 132, which in turn lifts an armature plunger 132*a* and unlatches the latch 32. The switch-transducer combination can be pressure-operated, i.e. by the weight of the balls 3, or optically actuated, e.g. by interference of a light beam by the ball.

Figure 9:
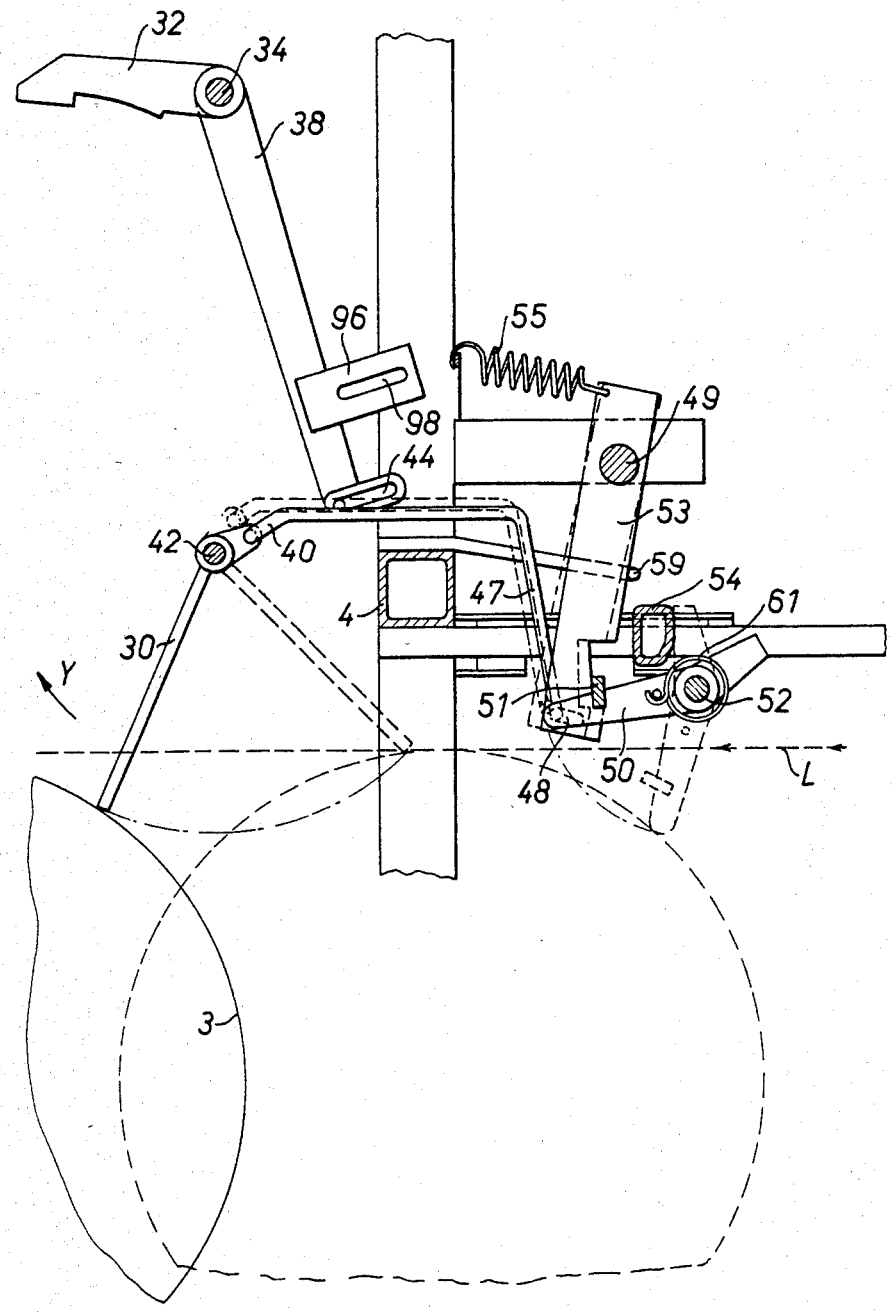
FIG. 9 shows a variant of the ball-return stop device.

In FIG. 9, a variant embodiment is shown in which the reverse running stopper 50 is held firmly in an inactive position during normal operation—that is, whenever the ball lift mechanism 6 has not been lowered—so that the balls 3, as they roll past this reverse running stopper 40, cannot create any noise. The reverse running stopper 50 is provided with a protrusion 51, which is suspended in a holder lever 53. This holder lever 53 is drawn by a spring 55 against a stop 59. The holder lever 53 is pivotably supported at the top about a pivot shaft 49 and at its lower end includes an oblong slot 48, which is engaged by a bell-crank-like pull rod 47. The pull rod 47 is coupled with the feeler 30 above its pivot shaft 42. The reverse running stopper 50 is loaded by a helical spring 61, which tends to move it into its blocking position, shown in broken lines.

Operation, with reference to FIG. 9:

Let it be assumed that a ball 3 is rolling normally in the direction of the arrow L. The ball 3 does not then touch the reverse running stopper 50, because the latter assumes the inactive position indicated in FIG. 9 by solid lines. The feeler 30 too, as the ball passes through, executes only a pivoting movement in the direction of the arrow Y, without thereby triggering any function. As has already been explained with reference to FIGS. 7 and 8, this kind of pivoting movement on the part of the feeler 30 causes only an idle movement of the connecting rod 40 in the oblong slot 44. The connecting rod 47 also executes an idle movement in its oblong slot 48, without thereby moving the holder lever 53. However, if for any reason the ball 3 is not engaged by the transport belt 9 and rolls backward, the feeler 30 is pivoted into the position shown by broken lines in the direction opposite from that of the arrow Y. Since this feeler 30 is connected with the pull rod 47, this feeler movement causes a corresponding pivoting movement of the holder lever 53, the result then being that the protrusion 51 of the reverse running stopper 50 comes unlatched, and the stopper 50, under the influence of the helical spring 61 mounted on the pivot shaft 52, executes a pivoting movement, thereupon assuming the position shown in broken lines in FIG. 9, where it rests against the buffer 54. In this position—as already explained with reference to FIG. 6—it prevents the ball 3 from rolling backward and thereby tenses the spring 6, as has been explained with respect to FIG. 6. As the next ball arrives, rolling in the direction L, this reverse running stopper 50 then is pivoted back into its inactive position, in the opposite direction, and its protrusion 51 is once again suspended in the holder lever 53, so that subsequently the position described at the outset is assumed. In this manner, substantially low-noise operation is assured.

Instead of a spring 60, the reverse running stopper 50 can also be connected with a cable which is guided over at least one deflecting roller and is stressed by a weight.

I claim:

1. Return bowling ball lifting apparatus, for combination with a bowling ball return race or track (2) in which bowling balls (3) are moved towards a playing position (100), said apparatus including a support frame (4)

a ball lift mechanism (6) having an elongated frame (18, 20, 21), a pair of rollers (7, 8) positioned on the frame adjacent the end positions thereof, belt means (9) engageable with a bowling ball (3) to be lifted from the race (2) to an elevated position (100), looped about the rollers (7, 8), a latch lever (22) and a movable latch (32), and comprising, feeler means (30, 62, 130) extending into the path of the bowling ball (3) on the race (20 and sensing presence of the ball (3) at a predetermined unusual position on the race;

means (38; 132, 132*a*) for coupling the latch (32) to the feeler means (30, 62, 130) for unlatching movement of the latch lever upon sensing of a ball at said predetermined, unusual position;

means (12, 13, 24, 22, 32, 38; 66, 68, 70–98, 38) for permitting moving the entire ball lift mechanism from a first, or normal position in which the lowermost point of the lower roller (7) of the pair (7, 8) is clear of a ball passing therebeneath, to a second or lower position, said moving means being coupled to and controlled by the feeler means and operative to effect said movement upon sensing of a ball at said predetermined position on the race and thereby engage the ball and lift the ball, said moving means including link means (10, 12, 13) pivotably and linkably retaining the ball lift mechanism frame (18, 20, 21) on the support frame for pivoting movement about a horizontal axis (23); a support arm (28) attached to the moving means for the ball lift frame (18);

an adjustable fixed abutment (26) secured to the support frame (4), the support arm being engageable with the fixed abutment (26) and forming a fulcrum point for pivoting movement of the ball lift mechanism frame (18, 20, 21) upon movement of the ball lift mechanism (6) from the second position to said first, or normal position;

the elongated frame, and the ball race, in a rising portion (19) of the ball race narrowing in an upward direction, a ball between the frame and the race pivoting the elongated lift mechanism frame about said fulcrum point and moving the ball lift mechanism frame into the normal position for retention thereof by said latch upon engagement with the latch lever (22);

and reset means (26, 28) coupled to the ball lift mechanism (6) to return the ball lift mechanism to said first or normal position upon lifting of the ball beyond a predetermined level.

2. Apparatus according to claim 1 including a support frame (4);

link means (10, 12, 13) pivotably and longitudinally movably mounting said lifting mechanism frame (18, 20, 21) on the apparatus support frame (4) in position for pivotal movement of the lift mechanism frame (18, 20, 21) by the ball being lifted thereby and automatic operation of the reset means (26, 28) as the lift mechanism frame (18, 20, 21) is pivoted by the ball being transported along a rising path (19) of the race (2).

3. Apparatus according to claim 1 including a spring-loaded reverse running block (50, 60) located in advance—with respect to normal running direction—of the ball (3) of the feeler lever (30).

4. Apparatus according to claim 3 wherein the reverse running block (50–60) comprises a holding lever (53);

a spring-loaded reverse running-stop element (50), the reverse running-stop element (50) being retained in non-locking position by the holding lever;

and an operating element (47) coupled to the feeler (30) and to the holding lever to move the holding lever in a direction to release the reverse running-stop element (50) if the feeler senses movement of the ball (3) in a direction (P) opposite to ball-delivery direction, the spring-loading of the holding lever retaining said holding lever in a direction to maintain the reverse-running stop element in reverse-running blocking direction.

5. Apparatus according to claim 1 wherein the feeler means comprises a feeler lever (30) positioned to be engaged by a ball, the feeler lever being mounted for free pivoting movement upon engagement with a ball operating in ball supplying direction (L), the feeler lever being actuated by the ball when the ball is running on the race or track (2) in reverse direction (P), and actuating the feeler for operating the ball lift mechanism moving means (12, 13, 24, 22, 32, 38).

6. Apparatus according to claim 1 wherein the feeler (62) comprises a feeler element movably secured to a support frame (4);

and a time-delay mechanism (66–98, 38) interposed between the feeler element (62) and the ball lift mechanism moving means.

7. Apparatus according to claim 6 wherein the ball mechanism moving means includes a latch lever (22) and a latch (32) operative to engage, or disengage with respect to the latch lever;

and the time-delay mechanism is interposed between the feeler element (62) and the latch lever.

8. Appparatus according to claim 7 wherein the time-delay mechanism comprises a mechanical time delay including a latch operating lever (38);

a pull rod (92);

a gear (83);

and a clutch means (78, 88) rotatably connected to the gear;

and a lost motion coupling connecting the gear (83) and the pull rod, and the latch operating lever (38), the lost motion coupling effecting said time delay due to free rotation of the gear for a predetermined rotary angle.

9. Apparatus according to claim 8 wherein the clutch comprises a rotatably driven disk (84);

a roller (88) rotating with the disk and having a smaller diameter;

a coupling disk (78) engageable with said roller;

and a pivotable lever, the roller being engageable with the coupling disk upon operative movement of the feeler element (62) transferred to the coupling disk;

and a step-down transmission (82, 83) coupled to the pull rod (92) and the coupling disk.

10. Apparatus according to claim 9 wherein the step-down transmission comprises a gear (83) having a central axis (77);

a lever (76) retaining the central axis;

and the pull-rod being coupled to the lever (76) and pulling the lever in a direction to increase the friction between the coupling disk (78) and the roller (88).

11. Apparatus according to claim 1 wherein the feeler comprises a ball position transducer and switch element (130) sensing presence of a ball at said predetermined position and generating an electrical signal;

an electromagnet (**132, 132*a***) is provided coupled to and controlled by said transducer operative to move the movable latch;

and wherein the coupling means comprises an electrical circuit between the electromagnet and the latch.

12. Return bowling ball lifting apparatus, for combination with a bowling ball return race or track (2) in which bowling balls (3) are moved towards a playing position (100), said apparatus including a ball lift mechanism (6) having an elongated frame (18, 20, 21), a pair of rollers (7, 8) positioned on the frame adjacent the end positions thereof, belt means (9) engageable with a bowling ball (3) to be lifted from the race (20) to an elevated position (100), looped about the rollers (7, 8);

and comprising, feeler means (30, 62, 130) extending into the path of the bowling ball (3) on the race (2) and sensing presence of the ball (3) at a predetermined unusual position on the race, wherein the feeler means comprises a feeler lever (30) positioned to be engaged by a ball, the feeler lever being mounted for free pivoting movement upon engagement with a ball operating in ball supplying direction (L), the feeler lever being actuated by the ball when the ball is running on the race or track (2) in reverse direction (P), and actuating the feeler for operating the ball lift mechanism moving means (12, 13, 24, 22, 32, 38), means (12, 13, 24, 22, 32, 38; 66, 68, 70–98, 38) for permitting moving the entire ball lift mechanism from a first, or normal position in which the lowermost point of the lower roller (7) of the pair (7, 8) is clear of a ball passing therebeneath to a second or lower position, said moving means being coupled to and controlled by the feeler means and operative to effect said movement upon sensing of a ball at said predetermined position on the race and thereby engage the ball and lift the ball;

and reset means (26, 28) coupled to the ball lift mechanism (6) to return the ball lift mechanism to said first or normal position upon lifting of the ball beyond a predetermined level.

13. Apparatus according to claim 12, including a time delay mechanism (66–98; 38) interposed between the feeler lever and the ball lift mechanism moving means.

14. In a bowling alley having a bowling ball return race or track (29 in which bowling balls (3) are moved towards the player's position, said return race or track (2) for the ball having a rising part, a return bowling ball lifting apparatus installed at the player's position including a support frame (4)

a ball lift mechanism (6) having an elongated frame (18, 20, 21), a pair of rollers (7, 8) positioned on the frame adjacent the end positions thereof belt means (9) engageable with a bowling ball (3) to be lifted from the race (2) to an elevated position (100), looped about the rollers (7, 8)

and comprising, feeler means (30, 62, 130) extending into the path of the bowling ball (3) on the race (2) and sensing presence of the ball (30) at a predetermined unusual position on the race, including a feeler lever positioned in interfering relation with the movement of the ball (30) when the ball moves in a direction (P) contrary to supplying or running direction (L) thereof, means (12, 13, 24, 22, 32, 38; 66, 68, 70–98, 38) for permitting moving the entire ball lift mechanism from a first, or normal position in which the lowermost point of the lower roller (7) of the pair (7, 8) is clear of a ball passing therebeneath, to a second or lower position, said moving means being coupled to and controlled by the feeler means and operative to effect said movement upon sensing of a ball at said predetermined position on the race and thereby engage the ball and lift the ball, link means (10, 12, 13) pivotably and longitudinally movably mounting said lifting mechanism frame (18, 20, 21) on the apparatus support frame (4) in position for pivotal movement of the lift mechanism frame (18, 20, 21) by the ball being lifted thereby and automatic operation of the rest means (26, 28) as the lift mechanism frame (18, 20, 21) is pivoted by the ball being transported along a rising path (19) of the race (2), a latch lever (22) and a movable latch (32), and means (38; 132, 132*a*) for coupling the latch (32) to the feeler means (30, 62, 130) for unlatching movement of the latch lever upon sensing of a ball at said predetermined, unusual position, and reset means (26, 28) coupled to the ball lift mechanism (6) to return the ball lift mechanism to said first or normal position upon lifting of the ball beyond a predetermined level.

15. Apparatus according to clain 14, including a time delay mechanism (66–98; 38) interposed between the feeler lever and the ball lift mechanism moving means.

* * * * *

UNITED STATES PATENT AND TRADEMARK OFFICE

CERTIFICATE OF CORRECTION

PATENT NO. : 4,509,752

DATED : April 9, 1985

INVENTOR(S) : August SCHMID

It is certified that error appears in the above-identified patent and that said Letters Patent is hereby corrected as shown below:

Title page, Item 73, "Seranta" should be -- SERANIA --

Signed and Sealed this

*Twenty-second* Day of *October 1985*

[SEAL]

*Attest:*

DONALD J. QUIGG

*Attesting Officer*

*Commissioner of Patents and Trademarks—Designate*